United States Patent [19]

Berkowitz

[11] 4,018,548

[45] Apr. 19, 1977

[54] ROTARY TROCHOIDAL COMPRESSOR

[75] Inventor: Murray Berkowitz, Woodcliff Lake, N.J.

[73] Assignee: Curtiss-Wright Corporation, Wood-Ridge, N.J.

[22] Filed: Dec. 8, 1975

[21] Appl. No.: 638,513

[52] U.S. Cl. ..... 418/61 A; 418/129; 418/142; 418/144; 418/178

[51] Int. Cl.[2] ..... F01C 19/04; F01C 19/08; F01C 1/02; F04C 27/00

[58] Field of Search ..... 418/61 A, 125, 129, 418/142, 144

[56] References Cited

UNITED STATES PATENTS

| | | | |
|---|---|---|---|
| 3,185,386 | 5/1965 | Peras | 418/129 |
| 3,226,013 | 12/1965 | Toyoda et al. | 418/61 A |
| 3,369,739 | 2/1968 | Abermeth | 418/129 |
| 3,387,772 | 6/1968 | Wutz | 418/61 A |
| 3,764,239 | 10/1973 | Huf | 418/125 |
| 3,883,276 | 5/1975 | Hofbauer | 418/144 |

FOREIGN PATENTS OR APPLICATIONS

| | | | |
|---|---|---|---|
| 583,035 | 12/1946 | United Kingdom | 418/61 A |
| 1,350,728 | 4/1974 | United Kingdom | 418/125 |

*Primary Examiner*—John J. Vrablik
*Attorney, Agent, or Firm*—Victor D. Behn; Arthur Frederick

[57] ABSTRACT

A rotary trochoidal compressor comprising a rotor mounted for planetary motion within a housing and in which the periphery of the rotor is substantially a hypotrochoid and the peripheral inner surface of the housing is the outer envelope of the rotor and in which a radially movable or elastic seal means is provided in the housing at the hypotrochoid generating points and the intake and outlet ports are so disposed in the housing on opposite sides of each hypotrochoid generating point such that each working chamber closes to an intake port before it opens to an outlet port, the working chamber being formed between the seal means at the rotor nose portions or between seal means at a rotor nose portion and at a hypotrochoid generating point.

1 Claim, 7 Drawing Figures

FIG. 5
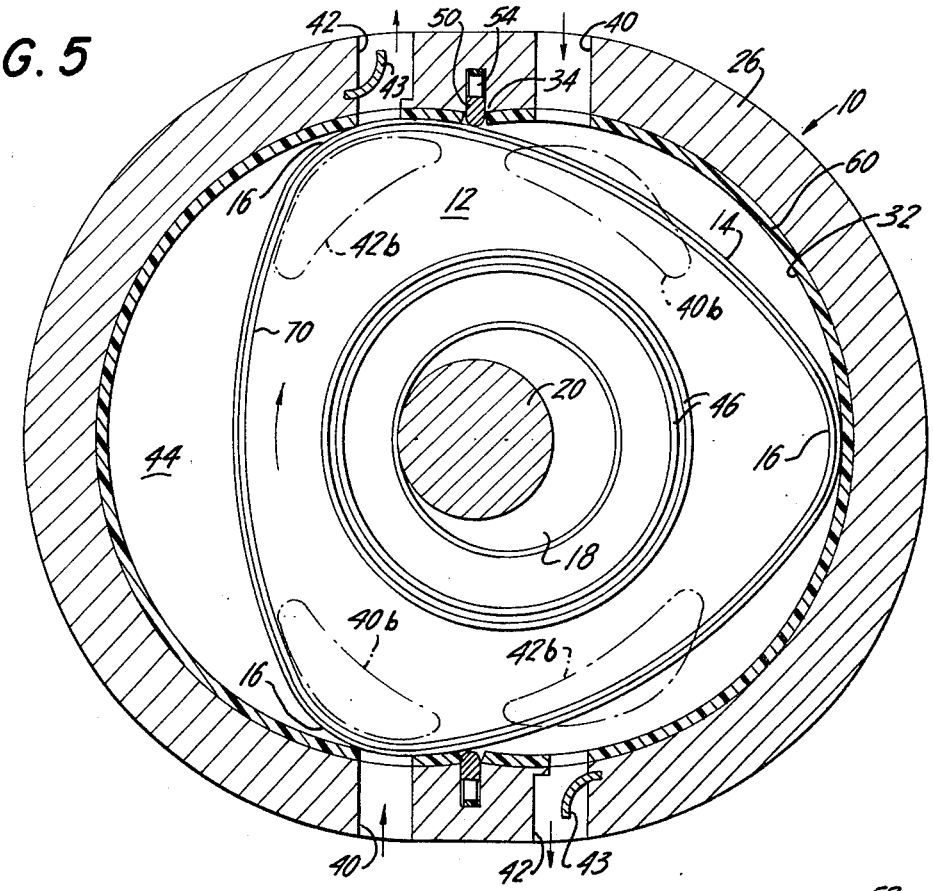
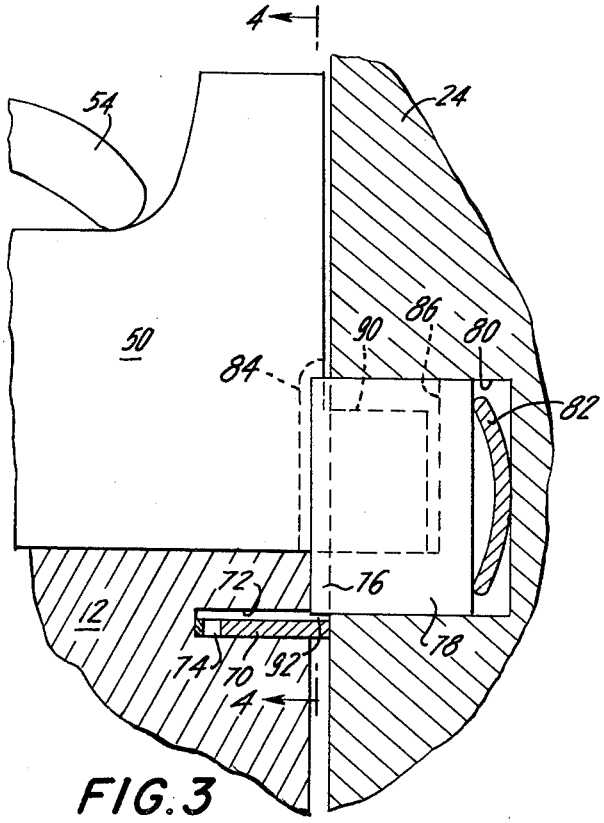
FIG. 3
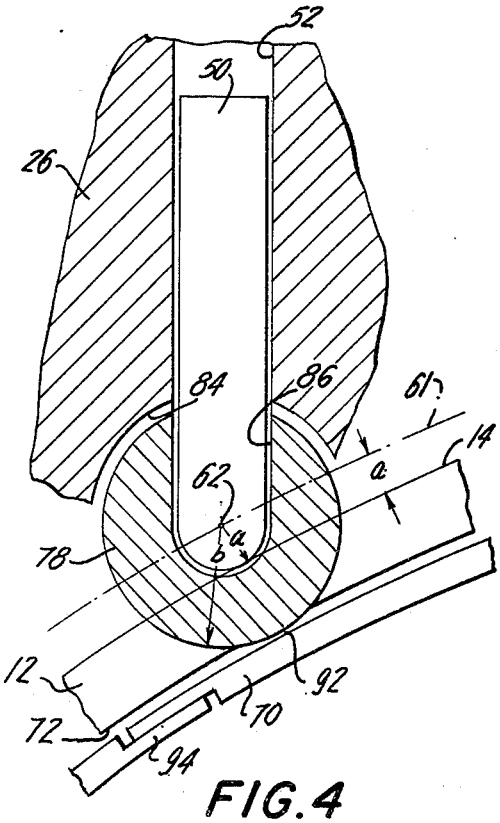
FIG. 4

ROTARY TROCHOIDAL COMPRESSOR

BACKGROUND OF THE INVENTION

The invention relates to rotary mechanisms, particularly to rotary compressors or expansion engines in which the rotor has a planetary motion within a housing and the peripheral surface of the rotor is substantially a hypotrochoid and the inner surface of the housing is substantially the outer envelope of the relative rotary motion of the rotor. Such a compression or expansion engine is disclosed in U.S. Pat. No. 3,387,772 granted June 11, 1968 to Wutz and in British Pat. No. 583,035 granted Dec. 5, 1946 to Maillard and is generally known as a Maillard-type compressor. The invention will herein be described in terms of compressor operation although as will be apparent it is also applicable to expansion engines.

Various trochoidal compressors have been proposed in the past in which either the outer periphery of the rotor or the inner periphery of the rotor housing is a trochoidal surface, either an epitrochoid or a hypotrochoid. For example, U.S. Pat. No. 3,671,153 granted on June 20, 1972 to Luck shows a compressor in which the inner surface of the rotor housing is an epitrochoid. Similarly, U.S. Pat. No. 3,452,643 granted July 1, 1969 to Pratt shows an expansion engine in which the inner surface of the rotor housing is an epitrochoid. A rotary mechanism having the geometry of the rotor and rotor housing shown in the Luck and Pratt patents is generally known as a Wankel-type rotary mechanism. It has been determined that a Maillard-type compressor has the advantage in that the minimum volume of each working chamber is reduced substantially to zero at the end of the discharge stroke of each working chamber thereby providing a compressor with relatively high volumetric efficiency.

The efficiency of a rotary compressor depends on the provision of adequate sealing for each working chamber. In a Wankel-type configuration it is difficult to provide adequate sealing between the rotor peripheral surface and the waist portions of the rotor housing because these waist portions do not generate the peripheral surface of the rotor, although in a Wankel-type configuration a seal bar can readily be provided at each apex portion of the rotor because each apex portion generates the epitrochoid inner surface of the rotor housing. However, a seal bar cannot readily also be provided at the waist portions of the rotor housing in a Wankel-type configuration particularly because of possible mechanical interference with the apex seal bars on the rotor.

Summary of the Invention

It is an object of the invention to provide a new and improved configuration for a Maillard-type rotary compressor having high volumetric efficiency and having an improved sealing arrangement for the compressor working chamber.

In accordance with the invention the compressor is provided with a radially movable bar seal or other elastically yieldable seal means at each point on the rotor housing which generates the hypotrochoid peripheral surface of the rotor, this seal being urged into contact with said rotor peripheral surface, and in addition, a seal is provided between the rotor nose portions and the rotor housing which does not interfere with said bar seal. In addition, in order to further improve the volumetric efficiency of such a compressor, the intake and outlet ports are positioned so that each working chamber is never simultaneously open to both said ports thereby minimizing any flow-back of compressed charge into the working chambers.

More specifically it is an object of this invention to provide a novel Maillard-type compressor in which the rotor housing has a radially movable bar seal or other elastically yieldable seal means at each hypotrochoid generating point and seal means compatible with said housing seal bar is provided between the rotor nose portions and the rotor housing and in which the inlet and outlet ports of the compressor are positioned so as not to have any overlap with respect to a working chamber. These seal features lead to an improvement in the volumetric efficiency of a Maillard-type compressor compared to that attainable with a Wankel-type configuration.

It is a further object of the invention to provide an improved seal configuration consisting of said elastically yieldable seal means (carried by the housing at each hypotrochoid generation point) which is engagable with the rotor hypotrochoidal surface and novel seal means on the housing engagable with the rotor sides to minimize leakage at the rotor sides adjacent to the generating point seals.

In accordance with the latter aspect of the invention, one or both of the rotor sides are provided with an axially movable seal strip which is parallel to the hypotrochoid surface of the rotor and is sealingly engagable with the adjacent housing end wall and said housing end wall has an axially movable pin-like member adjacent to the housing bar seal and sealingly engaging the adjacent rotor side to seal the space radially outwardly of said seal strip between said rotor side and adjacent housing end wall. An elastically yieldable member, for example, of elastomeric material may be substituted for said pin-like member.

In accordance with the invention, in order to minimize radial motion of the housing seal bar, the tip of the seal bar is rounded and the surface of the rotor instead of being a true hypotrochoid is made parallel to a true hypotrochoid generated by the center of curvature of the rounded tip of the seal bar and said rotor surface is disposed radially inwardly of said true hypotrochoid a distance equal to the radius of the rounded tip of the housing bar seal. In addition, to provide a sealing relation between the aforementioned axially-movable pin and the rotor side seal strip, the radially inner surface of said pin has a curvature with its center coaxial with the center of curvature of the rounded tip of its associated housing seal bar and the radius of said seal pin curvature is made substantially equal to the radial distance between said true hypotrochoid and the outer surface of said seal strip.

Other objects of the invention will become apparent upon reading the following detailed description in connection with the drawings.

BRIEF DESCRIPTION OF THE DRAWINGS

FIG. 3 is an enlarged view of a portion of FIG. 2;

FIG. 4 is a view taken along line 4—4 of FIG. 3;

FIG. 5 is a view similar to FIG. 1 but showing the compressor rotor in a different position;

DESCRIPTION OF PREFERRED EMBODIMENTS

Figure 1:
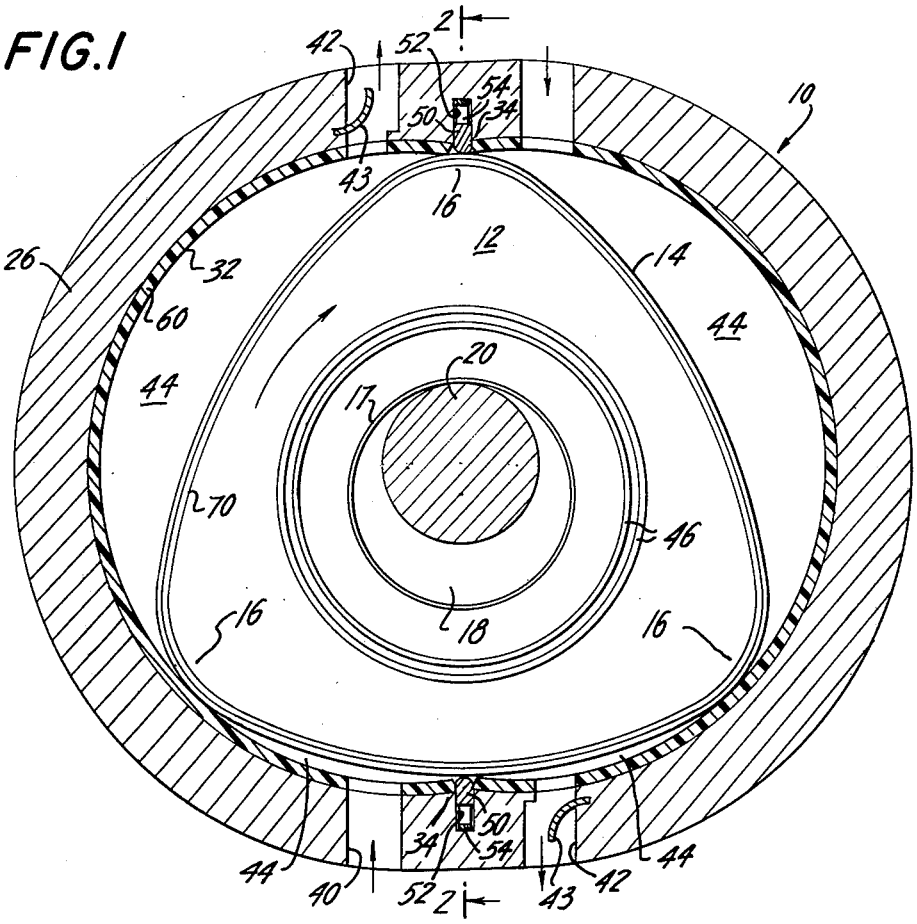
FIG. 1 is a transverse sectional view of a rotary compressor embodying the invention.
Figure 2:
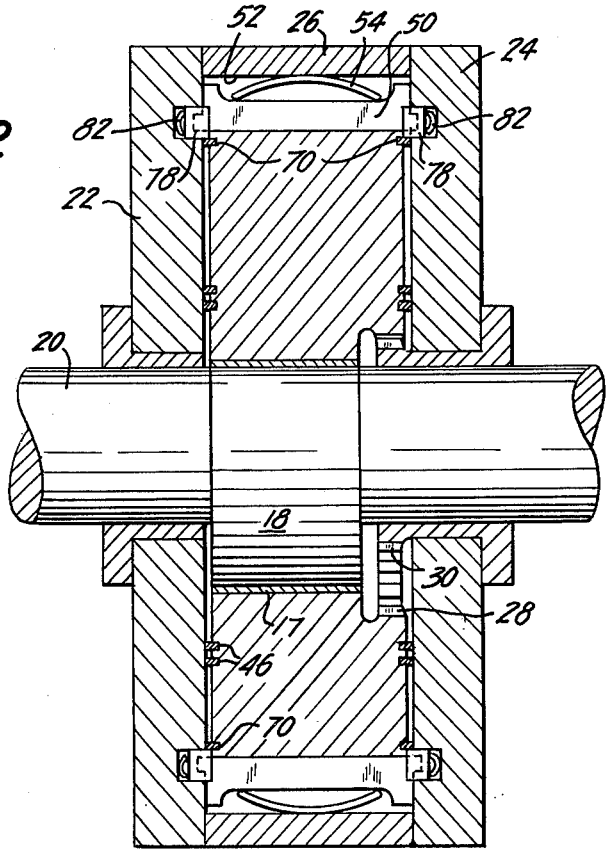
FIG. 2 is an axial sectional view taken along line 2—2 of FIG. 1.

Referring first to FIGS. 1 and 2 of the drawing which disclose a rotary compressor 10 in which the inner body or rotor 12 of the compressor has a peripheral surface 14 which is a hypotrochoid preferably having three apex or nose portions 16. The rotor 12 is rotatably journaled by a bearing 17 on the eccentric portion 18 of a shaft 20 which is coaxially supported in an outer body or housing consisting of a pair of axially-spaced end walls 22 and 24 and an intermediate peripheral wall or rotor housing 26. The housing walls 22, 24 and 26 are suitably secured together as by bolts (not shown).

The rotor 12 has an internal gear 28 secured to one end face of the rotor and disposed in mesh with a gear 30 secured to the adjacent housing end wall 24. The gears 28 and 30, in effect, form the rolling circles for generating the hypotrochoid surface 14. For generating a hypotrochoid having three apex portions as illustrated, the gears 28 and 30 are provided with a diameter ratio of 3:2.

The inner peripheral surface 32 of the intermediate or rotor housing 26 is approximately the outer envelope of the rotor trochoidal peripheral surface 14. That is, the surface 32 is approximately the outer envelope of the various positions of the rotor peripheral surface 14 relative to the rotor housing 26. The resulting peripheral surface 32 has two waist portions 34 which, in effect, generate the hypotrochoidal surface 14 as the rotor rotates relative to rotor housing 26. Therefore, each of the two waist portions 34, in effect, is a generating line (herein termed generating element) which extends axially across the rotor housing 26 and generates the hypotrochoid rotor surface 14 as the rotor 12 rotates relative to its rotor housing 26.

The rotary mechanism 10 is also provided with an intake port 40 and an outlet or exhaust port 42 disposed on opposite sides of each waist portion 34 of the rotor housing. Each exhaust port 42 preferably is provided with a check valve schematically shown at 43 to prevent reverse flow into the compressor.

With the structure described, a plurality of working chambers 44 are formed between the rotor 12 and rotor housing 26. Each of these chambers extend circumferentially from a rotor nose portion 16 to another nose portion or to a hypotrochoid generating element 34. If the shaft 20 rotates in a clockwise direction, as viewed in FIG. 1, the rotor 12 also rotates clockwise but at one-third the speed of the shaft. As the rotor 12 rotates, fluid is drawn in through the lower left-hand intake port 40 into a working chamber 44 and fluid is being pumped out through the upper left-hand exhaust port 42 from another working chamber 44, and at the same time fluid is similarly being drawn in through the upper right-hand intake port 40 and is being pumped out through the lower right-hand exhaust port 42. Thus, each half of the rotary mechanism 10 on opposite sides of a vertical plane through the generating elements or waist portions 34 of the rotor housing functions as a compressor. In order to prevent oil escaping from the rotor bearing 17 from leaking radially outwardly between the rotor and housing end walls 22 and 24, the rotor end faces are provided with one or more annular oil seals 46 received in grooves in the rotor end faces and urged axially by springs (not shown) against the adjacent housing end walls 22 and 24. The structure so far described is conventional.

For efficient compressor operation, adequate sealing must be provided between each generating element or waist portion 34 of the rotor housing and the trochoidal surface 14 of the rotor 12 and between each rotor nose 16 and the inner peripheral surface 32 of the rotor housing as well as between the sides of the rotor 12 and the adjacent end walls 22 and 24.

In accordance with one form of the invention, a radially movable seal bar 50 is provided at each waist portion 34 of the rotor housing to function as the hypotrochoid generating element. Each seal bar 50 is received within a radial groove 52 extending axially across the rotor housing 26 and a spring 54 at the bottom of the groove elastically urges the seal bar 50 radially inwardly into continuous contact with the hypotrochoidal peripheral surface 14 of the rotor 12. In this way, the seal bars 50 prevent leakage across each waist portion 34 of the rotor housing between working chambers 44 on opposite sides of said waist portion.

To further seal each working chamber 44 it is necessary that seal means be provided between each rotor nose portion 16 and the inner surface 32 of the rotor housing. It is essential that this latter seal means have no mechanical interference with the seal bars 50 during passage of a rotor nose portion 16 under one of said seal bars. For this reason it is impractical to also utilize radial movable seal bars on each rotor nose portion 16 for sealing contact with the rotor housing surface 32.

In accordance with this invention the inner surface of the housing 26 is provided with a compressible liner 60 which is sufficiently thick in size so as to be elastically compressed slightly by contact with the nose portions 16 of the rotor thereby providing a seal therebetween. The liner 60 could be made of suitable elastomeric material, for example, silicone rubber sponge-type material, and be provided with a smooth or low friction wear-resistant skin. Such a skin (not shown) could be a plastic sheet bonded to the base sponge material of the liner 60 and consisting of teflon fibers layered or interwoven with fibers of other low friction material. Examples of such woven plastic material are commercially available under the trade names Fibriloid and Fiberglide from the Transport Dynamics Division of Lear Siegler, Inc.

Other types of elastically compressible liners could be substituted for the elastomeric liner 60. Also, the rotor housing surface 32 could also be provided with labyrinth-type grooves to provide the seal between said housng surface and the rotor nose portions 16. The specific details of the seal between each rotor nose portion 16 and the inner surface 32 of the rotor housing form no part of this invention. It is essential, however, that some form of seal be provided between each rotor nose portion 16 and the rotor housing which does not mechanically interfere with the housing seal bars 50.

Each housing seal bar 50 preferably is provided with a rounded tip to minimize wear as this seal tip slides over the rotor surface 14. As a result of rotation of the rotor 12 relative to the rotor housing 26, the seal bar 50 is not always perpendicular to the rotor surface 14 and, in general, makes an angle to this surface which varies as the rotor rotates. Because of this angular variation of each seal bar 50 relative to the rotor surface and because the tip of the seal bar is rounded, the seal bar would have to shift radially in its slot 52 to maintain contact with the rotor surface if this surface were a true hypotrochoid. Such radial motion of the seal bar would be objectionable because it would involve frictional sliding of the seal bar along a side of its groove 52. Theoretically, this radial motion could be eliminated by providing the seal bar with a pointed tip. This is impractical however, since such a pointed tip would quickly wear to a blunt tip.

To avoid this problem and, as best seen in FIG. 4, the tip of each seal bar 50 is rounded with a radius *a* and the surface 14 of the rotor 12 instead of being made a true hypotrochoid is made parallel to a theoretical or true hypotrochoid 61 generated by the point 62 which is the center of curvature of the rounded tip of its seal bar 50, the surface 14 being displaced radially inwardly of the theoretical hypotrochoid 60 by the same distance *a*. This seal tip construction is similar to that shown in British Pat. No. 1,154,090 granted June 4, 1966 to Huf, but for a rotor having an epitrochoidal peripheral surface rather than a hypotrochoid. With this construction, the point 62 will generate a true or theoretical hypotrochoid 60 as the rotor rotates. At the same time, since the rotor surface 14 is parallel to this true hypotrochoid by a distance *a* which is the same as the tip radius of the seal bar 50, no radial motion of the seal bar 50 is required to maintain sealing contact with the rotor surface 14 even though the angle between the seal bar 50 and rotor surface 14 changes during each rotation of the rotor. Some radial motion of the seal bar 50 will, of course, take place in actual practice because of such factors as manufacturing tolerances and bearing clearances. Also, since the distance *a* is small and since the rotor peripheral surface 14 is parallel to a true hypotrochoid, the surface 14 is substantially a hypotrochoid.

In order to provide a seal between the slide or end face of the rotor 12 and the adjacent end housing end wall 22 or 24, said rotor side or end face is provided with an axially movable seal strip 70, as best seen in FIGS. 3 and 4. Preferably such a seal strip 70 is provided at each rotor end face. Each seal strip 70 is received within a groove 72 in its rotor end face and a spring 74 at the bottom of the groove elastically urges the seal strip into sealing contact with the adjacent housing end wall. Also, each seal strip 70 is disposed close to the hypotrochoid surface 14 of the rotor and is parallel to that surface.

With the seal construction so far described and with each seal bar 50 extending axially completely across the rotor housing 26, a small leakage path would nevertheless exist between each seal bar and the side seal strip 70 through the area 76 between the end face of the rotor 12 and the adjacent housing end wall 22 or 24. To close this leakage area 76, the adjacent housing end wall 22 or 24 (24 in FIG. 3) is provided with an axially movable cylindrical pin 78 which is received within a recess 80 in said housing end wall. A spring 82 behind each pin 78 elastically urges it axially into contact with the adjacent end surface of the rotor 12. For this purpose, the adjacent portion of the rotor housing 26 has a recess 84 so as not to interfere with the axial movement of the pin 78 against the end surface of the rotor. Also, for this purpose the end of the pin 78 facing its adjacent seal bar 50 is slotted as shown at 86 to straddle the adjacent end of the seal bar. The slot 86 preferably has substantially the same width as the groove 52 in which the seal bar 50 is received. In this way the seal bar 50 also does not interfere with axial movement of the pin 78 against the adjacent end face of the rotor 12. Also, the seal bar 50 preferably has an axial extension 90 extending into the slot 86 of each seal pin 78 to minimize any leakage between each seal pin 78 and its associated seal bar 50.

Each cylindrical seal pin 78 has its axis coaxial with the center of curvature 62 of the rounded tip of the seal bar 50. Also, the radius *b* of at least the radially inner side of the seal pin, that is, the side adjacent to the seal strip 70, is made substantially equal to the radial distance between each seal strip 70 and the true hypotrochoid 61 generated by said center of curvature 62. Actually, as shown in FIG. 4, the radius *b* is made slightly smaller than the distance between the true hypotrochoid 61 and the seal strip 70 to provide a small clearance 92 only to avoid mechanical interference between the seal pin 78 and the seal strip 70, for example, because of manufacturing tolerances or bearing clearances.

With the seal pin 78 being coaxial with the generating point 62 for the true hypotrochoid 61 and having a radius *b* of the magnitude described, and with the seal strip 70 being parallel to the true hypotrochoid 61, the small clearance 92 between the rotor seal strip 70 and the housing seal pin 78 remains substantially constant in all positions of the rotor.

The rotor seal strips 70 need not be a one-piece strip. For example, it may consist of segments having overlapping joints such as shown at 94 in FIG. 4.

Reference is now made to FIG. 5 which shows the rotor 12 in a position in which one rotor nose portion 16 (the upper one in FIG. 5) is just moving past an outlet port 42. That is, the rotor 12 is in a position in which it has just completed discharge of a working chamber 44 through a port 42. As illustrated in FIG. 5, with the rotor 12 in this position, the seal between said rotor nose portion 16 and the housing inner surface 32 has almost reached the housing seal bar 50 so that the circumferential distance between their seal points is approaching a small value. This fact, coupled with the close fit (that is, the absence of any significant clearance) between the rotor periphery 14 and the housing surface 32 in this region results in the volume of this working chamber, which has just completed its discharge, being substantially zero. As a result, the compressor 10 has a high volumetric efficiency.

The fact that the circumferential dimension as well as the radial dimension of each working chamber 44 decreases during the compression stroke is a distinct advantage over conventional piston-type compressors or in compressors of the type shown in U.S. Pat. No. 3,226,013 (FIGS. 21 or 23 ) granted Dec. 28, 1965 to Toyoda et al or in U.S. Pat. No. 724,665 granted Apr. 7, 1903 to Cooley and generally known as a Cooley-type compressor. In such prior art compressors only the radial dimension of the compressor working chambers decreases during the compression stroke and as a result their minimum volume cannot be reduced to the same extent as in compressors of this invention. In this latter connection it is noted that in a Cooley-type compressor the rotor has an epitrochoidal surface which, in the minimum volume position of a working chamber, theoretically can be made to fit very close to the adjacent portion of the rotor housing. However, in order to facilitate fluid flow from each working chamber into the outlet port, and to avoid mechanical interference between the rotor and rotor housing, a significant minimum volume must be provided between the rotor and rotor housing of a Cooley-type compressor.

In the above discussion of volumetric efficiency of the compressor 10 of the present invention, it is assumed that the check valve 43 in each compressor outlet port is disposed close to the inner peripheral surface 32 of the rotor housing so that the volume of the space between the check valve and said inner peripheral surface of the rotor housing is small.

Another advantage of the compressor 10 over a compressor having a Cooley-type configuration lies in the fact that by positioning the intake and outlet ports 40 and 42 sufficiently close to a hypotrochoid generating seal bar 50, as illustrated, there is no overlap (that is, no period of simultaneous opening) of the intake and outlet ports 40 and 42 respectively to a working chamber 44. Thus, as shown in FIG. 5, the left-hand working chamber 44 has just moved past and is out of communication with the lower left-hand intake port 40 and has not as yet moved into communication with the upper left-hand outlet port 42. Therefore, each working chamber 44 receives its complete charge before opening to an outlet port 42. Accordingly, any flow-back, for example because of the small volume of compressed gas trapped between the check valve 43 and the rotor housing inner surface 32, does not in any way decrease the charge drawn into the working chamber through the intake port.

In lieu of placing the ports 40 and 42 in the peripheral wall or rotor housing 26, said ports could be placed in one or both side housings 22 or 24 in addition to or in lieu of the ports 40 and 42. Thus, FIG. 5 shows alternate inlet ports **40*b* and alternate outlet ports 42*b* in the housing end wall 22 or 24** by a dot and dash outline.

Figure 6:
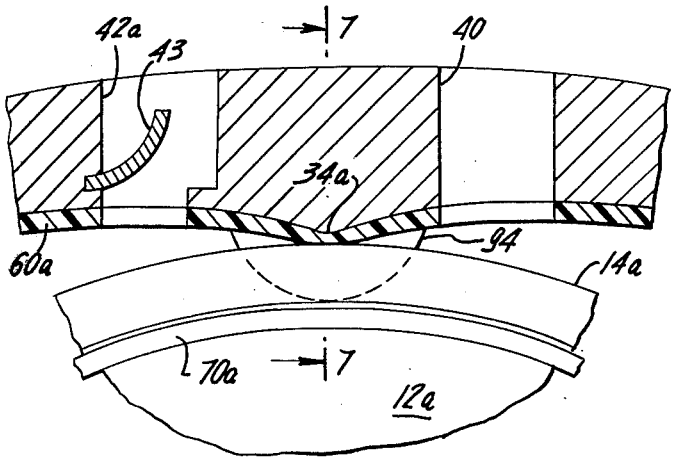
FIG. 6 is an enlarged partial view showing a modification of the structure shown in FIGS. 3 and 4.
Figure 7:
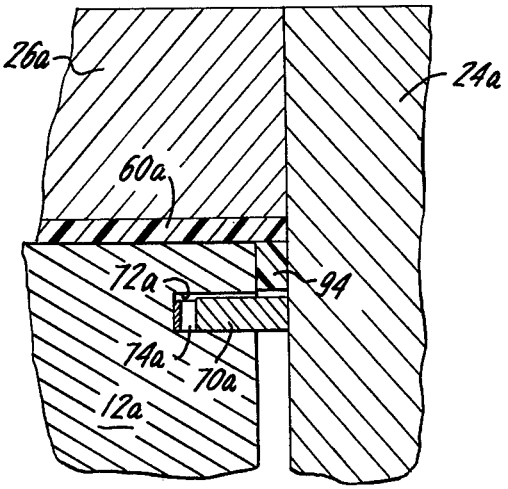
FIG. 7 is a sectional view taken along line 7—7 of FIG. 6.

Instead of the pin 78 elastically urged into contact with the adjacent end face of the rotor 12 for closing what otherwise would be a leakage area 76, elastomeric material (similar to the liner 60) could be used for this purpose. Such a modification is illustrated in FIGS. 6 and 7. For ease of understanding, the parts of FIGS. 6 and 7 corresponding to the parts of FIGS. 1–4 have been designated by the same reference numerals but with the subscript *a* added thereto.

In FIGS. 6 and 7, in lieu of the seal pins 78 of FIGS. 1–4, an elastomeric seal element 94 is bonded to each end housing (only end housing **24*a* is illustrated in FIGS. 6–7) under each generating element or waist portion 34*a* of the rotor housing 26*a*. Each seal element 94 has a thickness such that it is elastically compressed between the adjacent end face of the rotor 12*a* and the end housing 24*a*. Also, the radially inner surface of the seal element 94 preferably has substantially the same radius of curvature and center of curvature as described for the seal pins 78. Thus, the elastically compressible seal elements 94 of FIGS. 6–7 function to seal the same leakage area as the seal pins 78 of FIGS. 1–4**.

The modification of FIGS. 6 and 7 also differs from that of FIGS. 1–4 in that the metal or rigid seal bars which in FIGS. 1–4 are elastically urged into contact with the rotor hypotrochoid surface, are replaced by having the elastomeric liner **60*a* extend across the waist portions 34*a* of the rotor housing 26*a*. In this way, the portion of the liner 60*a* at each waist portion 34*a* functions as the generating element for the hypotrochoid surface 14*a* of the rotor 12*a* and is urged by its own elasticity into continuous contact with the rotor surface 14*a* as the rotor rotates. Thus the liner 60*a* is made sufficiently thick so as to be continuously compressed by the nose portions of the rotor 12*a* and so as to be continuously compressed by the rotor surface 14*a* at each of the waist portions 34*a* of the rotor housing 26*a*. It is clear, therefore, that the portion of the elastically compressible liner 60*a* at each waist portion of the rotor housing performs the same sealing function in FIGS. 6 and 7 as do the sealing bars 50 in FIGS. 1–4**.

It should be understood that the compressible seal elements 94 and the axially movable seal pins 78 each could be used in combination with either the hypotrochoid generating seal bars 50 of FIGS. 1—4 or with the compressible waist portions **34*a* of FIGS. 6–7**.

The modification of FIGS. 6–7 has the disadvantage compared to that of FIGS. 1–4, in that the portion of the compressible liner **60*a* at the rotor housing waist portions 34*a* is subject to continuous wear contact with the rotor hypotrochoid surface 14*a*, whereas the balance of this liner is only intermittently subject to wear from the rotor nose portions. The construction of FIGS. 6–7, however, has the advantage of being simpler and therefore for certain applications may be preferred to that of FIGS. 1–4**.

As already noted, although the invention has been described in terms of compressor operation, the invention is equally applicable to expansion engines. Also, the invention is not limited to the specific geometric configuration illustrated. For example, the hypotrochoid surface **14*a*** of the rotor could have a different number of nose portions by changing the diameters of the rolling circles from which the hypotrochoid is generated.

While the invention has been described in detail in its present preferred embodiments, it is obvious to those skilled in the art, after understanding the invention, that various changes and modifications may be made therein without departing from the spirit and scope thereof. The appended claims are intended to cover such modification.

What is claimed is:

1. A rotary mechanism such as a compressor, expansion engine or the like comprising:

a. an outer body comprising a pair of axially-spaced end walls and an intermediate wall defining a cavity therebetween;

b. an inner body mounted for relative rotation within said cavity and having its axis eccentric to the axis of said outer body, the peripheral surface of said inner body being substantially a hypotrochoid with three nose portions and the inner peripheral surface of said outer body intermediate wall being substantially the outer envelope of the hypotrochoidal peripheral surface of the inner body such that said intermediate wall peripheral surface has two diametrically opposed regions which generate said hypotrochoidal surface and such that a plurality of working chambers are formed between said inner body and said intermediate wall;

c. said nose portions of the inner body having sealing cooperation with the inner surface of the housing intermediate wall;

d. a radially movable seal bar carried by the outer body intermediate wall at each of said hypotrochoid generating regions and spring means for urging each seal bar into sealing contact with the hypotrochoid peripheral surface of the inner body;

e. said outer body having intake and discharge ports so disposed on opposite sides of each said seal bar such that each working chamber moves out of communication with an intake port before it subsequently moves into communication with a discharge port;

f. axially movable seal strip means carried by and end face of the inner body for sealing engagement with the adjacent outer body end wall, said seal strip means being disposed adjacent and parallel to but radially inwardly of the hypotrochoidal peripheral surface of the inner body; and g. an axially movable seal pin carried by said last-mentioned end wall of the outer body adjacent to each seal bar with each said seal pin having a recess for receiving an extension of the adjacent end of its associated seal bar, and spring means for urging said axially movable seal pin into sealing engagement with the adjacent portion of the end surface of the inner body extending from said disposed radially outwardly of said seal strip means and with the outer body intermediate wall being recessed adjacent to each seal pin to permit the seal pin to move axially into said sealing engagement with the end surface of the inner body.

* * * * *